US006574806B1

(12) United States Patent
Maher

(10) Patent No.: US 6,574,806 B1
(45) Date of Patent: Jun. 10, 2003

(54) INFANT SEAT ROCKING DEVICE

(76) Inventor: Charles E. Maher, 8518 Salem, Dearborn Heights, MI (US) 48127

( * ) Notice: Subject to any disclaimer, the term of this patent is extended or adjusted under 35 U.S.C. 154(b) by 0 days.

(21) Appl. No.: 10/034,673

(22) Filed: Dec. 28, 2001

(51) Int. Cl.[7] ..... A47D 9/02
(52) U.S. Cl. ..... 5/109; 297/260.2
(58) Field of Search ..... 5/109, 108, 101, 5/105, 104; 297/260.2, DIG. 11

(56) References Cited

U.S. PATENT DOCUMENTS

| | | | | | |
|---|---|---|---|---|---|
| 2,884,651 | A | * | 5/1959 | Garey | 5/109 |
| 2,908,917 | A | * | 10/1959 | Pinson | 5/109 |
| 3,653,080 | A | * | 4/1972 | Hafele | 5/108 |
| 3,806,966 | A | | 4/1974 | Thompson | |
| 3,851,343 | A | | 12/1974 | Kinslow, Jr. | |
| 4,856,130 | A | | 8/1989 | Berkovich | |
| D304,169 | S | | 10/1989 | Hoshino et al. | |
| 5,342,113 | A | | 8/1994 | Wu | |
| 5,615,428 | A | | 4/1997 | Li | |
| 5,686,884 | A | * | 11/1997 | Larkin et al. | 5/109 |

FOREIGN PATENT DOCUMENTS

| | | |
|---|---|---|
| WO | WO 85/05028 | * 11/1985 |

* cited by examiner

*Primary Examiner*—Alexander Grosz

(57) ABSTRACT

An infant seat rocking device for providing a smooth rocking motion for an infant without relying on the infant's own movement of the parent sitting with the child and rocking the seat. The infant seat rocking device includes a seat. The seat support member has a base portion, an upright portion and a connection portion. The upright portion of the seat support member extends from the seat offset with respect to a center of gravity of the seat for permitting rocking of the seat. A seat moving assembly is coupled to the seat support member. The seat moving assembly includes a crank arm and a strap member that extends from a distal end portion of the crank arm. The strap member has an end opposite the crank arm coupled to the seat member whereby rotation of the crank arm pulls on the seat for providing movement of the seat.

13 Claims, 2 Drawing Sheets

INFANT SEAT ROCKING DEVICE

BACKGROUND OF THE INVENTION

1. Field of the Invention

The present invention relates to infant seat rocking devices and more particularly pertains to a new infant seat rocking device for providing a smooth rocking motion for an infant without relying on the infant's own movement of the parent sitting with the child and rocking the seat.

2. Description of the Prior Art

The use of infant seat rocking devices is known in the prior art. U.S. Pat. No. 5,615,428 describes a device for swinging a cradle up and down. Another type of infant seat rocking devices is U.S. Pat. No. 3,851,343 having a lifting arm means for rocking the seat upwards.

While these devices fulfill their respective, particular objectives and requirements, the need remains for a device that includes has an improved seat moving assembly and greater adjustability.

SUMMARY OF THE INVENTION

The present invention meets the needs presented above by providing a seat moving assembly that has fewer moving parts and an adjustable nylon strap for varying the movement of the seat. The present invention also incorporates a rheostat for varying the speed of the motor.

Still yet another object of the present invention is to provide a new infant seat rocking device that keep the baby happy while parents are free to complete other tasks in the room.

Even still another object of the present invention is to provide a new infant seat rocking device that has a motor that accentuates the soothing affect of the present invention by creating a white noise.

To this end, the present invention generally includes a seat. A seat support member is coupled to the seat. The seat support member has a base portion, an upright portion and a connection portion. The upright portion of the seat support member extends from the seat offset with respect to a center of gravity of the seat for permitting rocking of the seat. A seat moving assembly is coupled to the seat support member. The seat moving assembly includes a crank arm and a strap member that extends from a distal end portion of the crank arm. The strap member has an end opposite the crank arm coupled to the seat member whereby rotation of the crank arm pulls on the seat for providing movement of the seat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
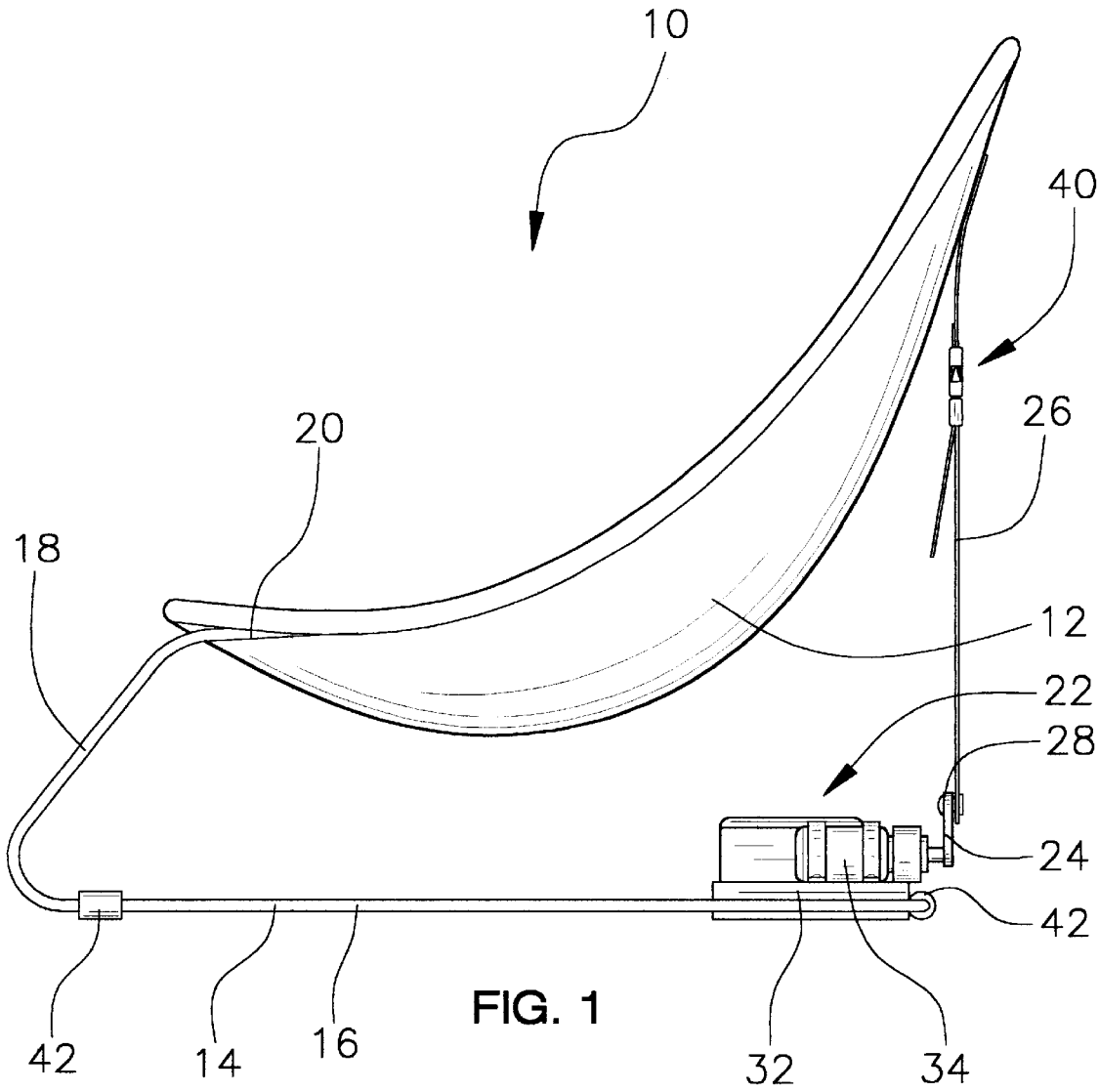
FIG. 1 is a side view of a new infant seat rocking device according to the present invention.
Figure 2:
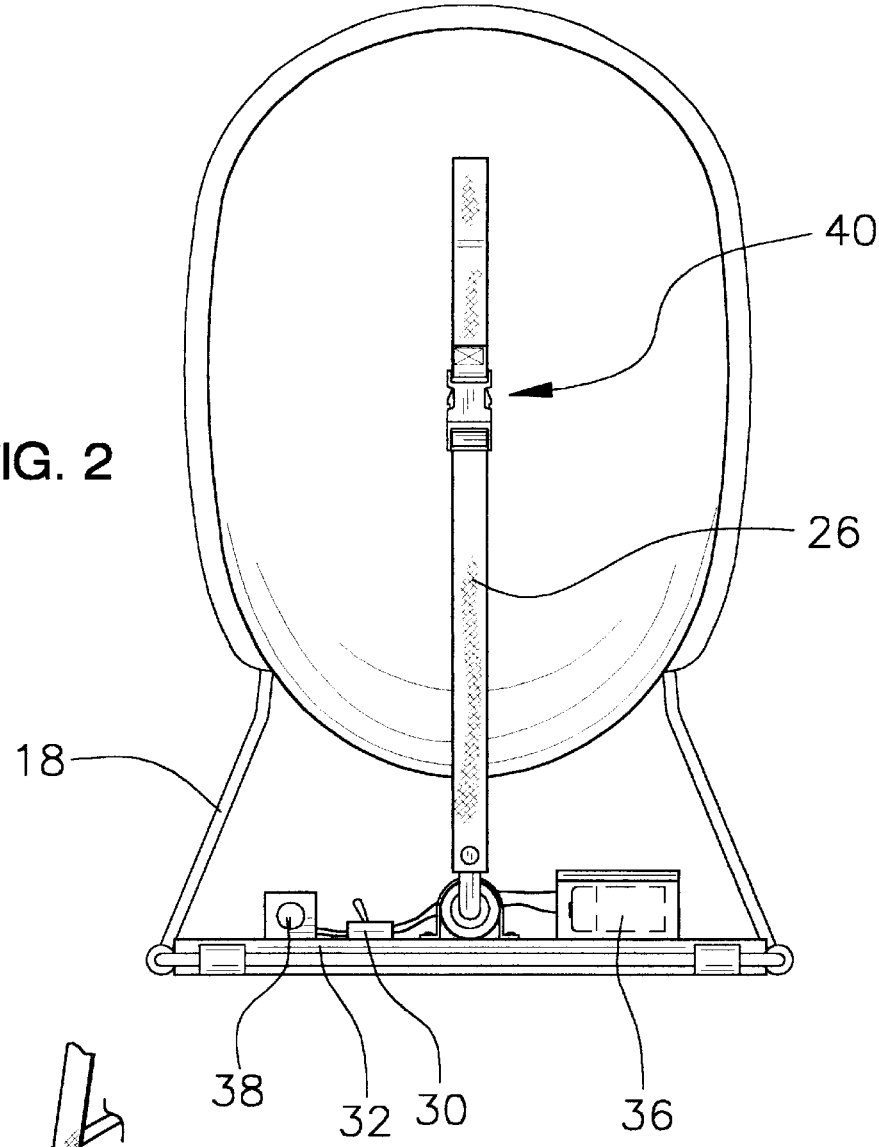
FIG. 2 is a rear view of the present invention.
Figure 3:
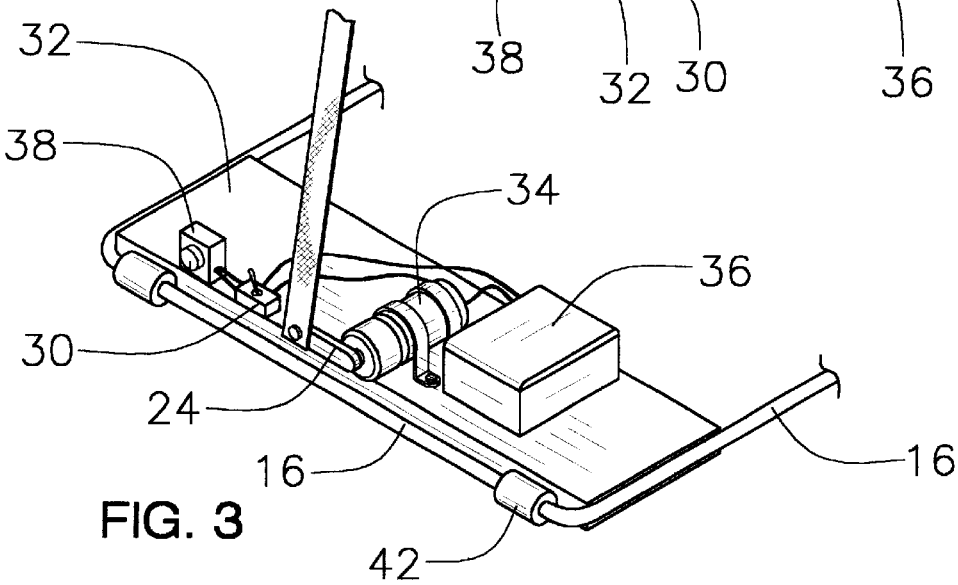
FIG. 3 is a perspective view of the present invention.

With reference now to the drawings, and in particular to FIGS. 1 through 3 thereof, a new infant seat rocking device embodying the principles and concepts of the present invention and generally designated by the reference numeral 10 will be described.

As best illustrated in FIGS. 1 through 3, the infant seat rocking device 10 generally comprises a seat 12. A seat support member 14 is coupled to the seat 12. The seat support member 14 has a base portion 16, an upright portion 18 and a connection portion 20. The upright portion 18 of the seat support member 14 extends from the seat 12 offset with respect to a center of gravity of the seat 12 for permitting rocking of the seat 12. A seat moving assembly 22 is coupled to the seat support member 14. The seat moving assembly 22 includes a crank arm 24 and an inelastic strap member 26 that extends from a distal end portion 28 of the crank arm 24. The strap member 26 has an end opposite the crank arm 24 coupled to the seat support member 14 whereby rotation of the crank arm 24 pulls on the seat 12 for providing movement of the seat 12.

The seat moving assembly 22 includes an on/off switch 30 coupled to the planar board member 32 and operationally coupled to the motor 34 for selectively activating the seat moving assembly 22. A power source 36 coupled to the planar board member 32 and operationally coupled to the motor 34. A rheostat 38 coupled to the planar board member 32 and operationally coupled between the motor 34 and the power source 36 whereby a speed of the crank arm 24 is adjustable using the rheostat 38.

The strap member 26 includes a buckle assembly 40 for disengaging the strap member 26 from the seat 12. The strap member 26 has an adjustable length for adjusting tension between the crank arm 24 and the seat 12. A plurality of foot members 42 coupled to the base portion 16 of the seat support member 14.

In use, the switch causing the motor to turn the crank, which in turn activates the seat moving assembly causing the seat to bounce rhythmically, would activate the present invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An infant seat rocking assembly comprising:

a seat;

a seat support member coupled to said seat, said seat support member having a base portion, an upright portion and a connection portion, said upright portion of said seat support member extending from said seat offset with respect to a center of gravity of said seat for permitting rocking of said seat;

a seat moving assembly coupled to said seat support member, said seat moving assembly including a crank arm and an inelastic strap member extending from a distal end portion of said crank arm, said inelastic strap member having an end opposite said crank arm coupled to said seat member whereby rotation of said crank arm pulls on said seat for providing movement of said seat; and said strap member including a buckle assembly for disengaging said strap member from said seat.

2. The infant seat rocking assembly of claim 1, further comprising:

said seat moving assembly including a motor operationally coupled to said crank arm.

3. The infant seat rocking assembly of claim 2, further comprising:

an on/off switch operationally coupled to said motor for selectively activating said seat moving assembly.

4. The infant seat rocking assembly of claim 2, further comprising:

a power source operationally coupled to said motor; and a rheostat operationally coupled between said motor and said power source whereby a speed of said crank arm is adjustable using said rheostat.

5. The infant seat rocking assembly of claim 1, further comprising:

a plurality of foot members coupled to said base portion of said seat support member.

6. The infant seat rocking assembly of claim 1, further comprising:

said seat moving assembly including a planar board member extending between opposite sides of said base portion of said seat support member.

7. An infant seat rocking assembly comprising:

a seat;

a seat support member coupled to said seat, said seat support member having a base portion, an upright portion and a connection portion, said upright portion of said seat support member extending from said seat offset with respect to a center of gravity of said seat for permitting rocking of said seat;

a seat moving assembly coupled to said seat support member, said seat moving assembly including a crank arm and an inelastic strap member extending from a distal end portion of said crank arm, said inelastic strap member having an end opposite said crank arm coupled to said seat member whereby rotation of said crank arm pulls on said seat for providing movement of said seat; and said strap member having an adjustable length for adjusting tension between said crank arm and said seat.

8. The infant seat rocking assembly of claim 7, further comprising:

said seat moving assembly including a motor operationally coupled to said crank arm.

9. The infant seat rocking assembly of claim 8, further comprising:

an on/off switch operationally coupled to said motor for selectively activating said seat moving assembly.

10. The infant seat rocking assembly of claim 8, further comprising:

a power source operationally coupled to said motor; and a rheostat operationally coupled between said motor and said power source whereby a speed of said crank arm is adjustable using said rheostat.

11. The infant seat rocking assembly of claim 7, further comprising:

a plurality of foot members coupled to said base portion of said seat support member.

12. The infant seat rocking assembly of claim 7, further comprising:

said seat moving assembly including a planar board member extending between opposite sides of said base portion of said seat support member.

13. An infant seat rocking assembly comprising:

a seat;

a seat support member coupled to said seat, said seat support member having a base portion, an upright portion and a connection portion, said upright portion of said seat support member extending from said seat offset with respect to a center of gravity of said seat for permitting rocking of said seat; and a seat moving assembly coupled to said seat support member, said seat moving assembly including a planar board member extending between opposite sides of said base portion of said seat support member, said seat moving assembly including a motor having a crank arm and an inelastic strap member extending from a distal end portion of said crank arm, said strap member having an end opposite said crank arm coupled to said seat member whereby rotation of said crank arm pulls on said seat for providing movement of said seat;

said seat moving assembly including an on/off switch coupled to said planar board member and operationally coupled to said motor for selectively activating said seat moving assembly;

a power source coupled to said planar board member and operationally coupled to said motor;

a rheostat coupled to said planar board member and operationally coupled between said motor and said power source whereby a speed of said crank arm is adjustable using said rheostat;

said strap member including a buckle assembly for disengaging said strap member from said seat, said strap member having an adjustable length for adjusting tension between said crank arm and said seat; and a plurality of foot members coupled to said base portion of said seat support member.

* * * * *